United States Patent [19]

Engstrom et al.

[11] Patent Number: 5,050,269

[45] Date of Patent: Sep. 24, 1991

[54] CONTROL KNOB

[75] Inventors: Scott M. Engstrom, North Lauderdale; Pete B. Gilmore, Sunrise, both of Fla.; Quah T. Hoh, Paya Terubung, Malaysia

[73] Assignee: Motorola, Inc., Schaumburg, Ill.

[21] Appl. No.: 634,947

[22] Filed: Dec. 28, 1990

Related U.S. Application Data

[63] Continuation of Ser. No. 402,312, Sep. 5, 1989, abandoned.

[51] Int. Cl.[5] ..... E05B 1/00

[52] U.S. Cl. ..... 16/118; 16/121; 16/DIG. 30

[58] Field of Search ..... 16/118, DIG. 12, DIG. 30, 16/121; 40/331, 325

[56] References Cited

U.S. PATENT DOCUMENTS

| | | | |
|---|---|---|---|
| 1,582,021 | 4/1926 | Geyer | 16/DIG. 12 |
| 1,632,227 | 6/1927 | Halsey | 16/DIG. 12 |
| 2,507,392 | 7/1945 | Williams | 40/331 |
| 3,061,869 | 11/1962 | Scalo | 16/DIG. 30 |
| 3,313,057 | 4/1967 | Leddy | 40/331 |
| 4,499,630 | 2/1985 | Harris | 16/DIG. 30 |
| 4,837,892 | 6/1989 | Lo | 16/DIG. 12 |

*Primary Examiner*—Richard K. Seidel
*Assistant Examiner*—Chuck Y. Mah
*Attorney, Agent, or Firm*—Michael J. Buchenhorner

[57] ABSTRACT

A knob (100) comprises an inner portion (105) made of a nonmetallic material and an outer portion (102) molded over the inner portion (105). The outer portion (102) comprises a material having a reduced hardness factor with respect to the inner portion (105).

2 Claims, 2 Drawing Sheets

CONTROL KNOB

This is a continuation of application Ser. No. 07/402,312 filed Sep. 5, 1989 and now abandoned.

TECHNICAL FIELD

This invention relates generally to instrument control devices, and more specifically to knobs for use in instrument control devices.

BACKGROUND

Instrument control knobs made of homogeneous material and used in portable instruments or devices (e.g., a radio) may bend or break the shafts that they are attached to when they impact against some rigid object. Moreover, such homogeneous knobs do not allow the designer of the instruments or devices on which the knob is used to design color features into those instruments or devices without painting the color features on the knob or without using a "multiple-shot" molding process.

SUMMARY OF THE INVENTION

Briefly, according to the invention, a knob comprises an inner portion made of a nonmetallic material, and an outer portion molded over the inner portion. The outer portion is made of a material having a reduced hardness factor will respect to the hardness factor of the inner portion.

DETAILED DESCRIPTION OF THE PREFERRED EMBODIMENT

Figure 1:
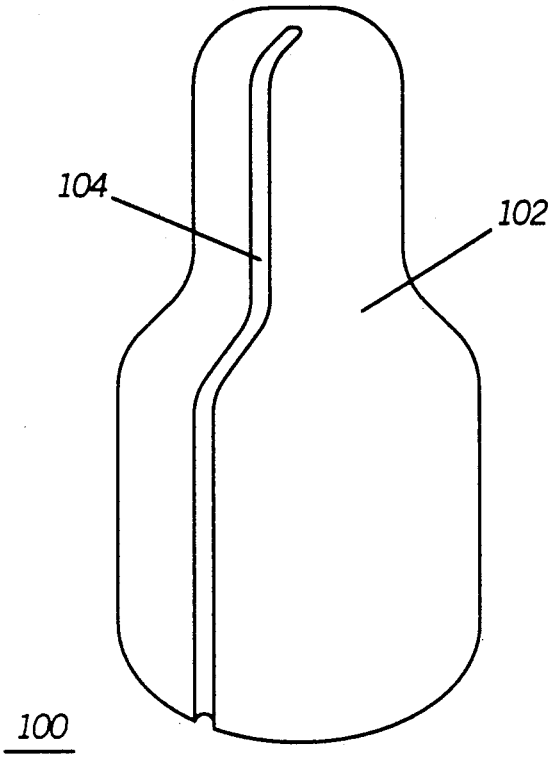
FIG. 1 shows the outer portion of a knob according to the present invention.

Referring to FIG. 1, the outer portion 102, of a knob 100 is shown. The outer portion 102 is molded over an inner portion 105 of the knob 100 (shown in FIG. 2). The outer portion 102 may be molded with a slot 104 therein.

Figure 2:
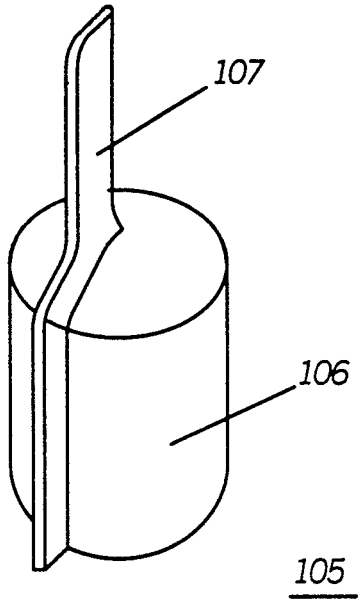
FIG. 2 shows the inner portion of the knob of FIG. 1.

Referring to FIG. 2, the inner portion 105 of the knob 100 is shown. The preferred inner portion 105 comprises a main body 106 and a blade portion 107. In a preferred embodiment the blade portion 107 is visible from outside the outer portion 102 (through the slot 104) and is of a color different from that of the outer portion so that it may be more easily seen from outside the outer portion.

Figure 3:
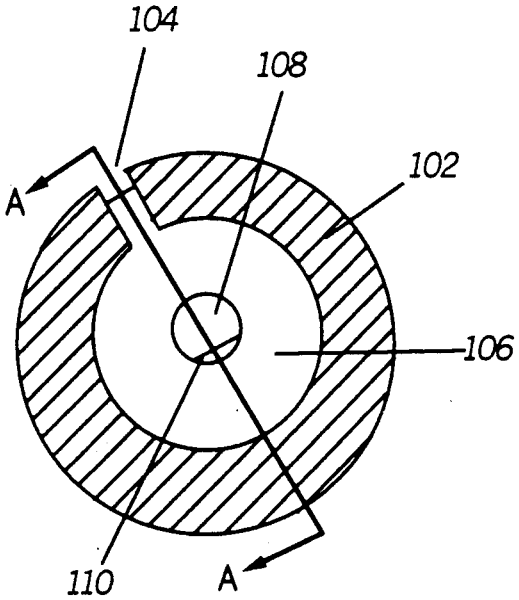
FIG. 3 shows a cross section of the knob of FIG. 1.

Referring to FIG. 3, a cross section of the knob 100 is shown. A shaft 108, with a flat portion 110, is attached to the inner portion 105 so that the inner portion 105 does not rotate with respect to the shaft 108. The inner portion is made of a nonmetallic material that must be hard enough to prevent such rotation. In a possible embodiment, the inner portion 105 is made of plastic. The outer portion 102 is made of a plastic or rubber material (e.g., urethane) having a reduced hardness factor (i.e., durometer) with respect to the inner portion 105. The dual durometer composition of the knob 100 resolves problems such as bending or breaking of the shaft 108, because the softer outer material dampens the effects of shock, while the inner material is hard enough to retain the knob 100 firmly on the shaft 108 so as to prevent the knob from rotating relative to the shaft 108. Dual color solves a process problem for products that require knobs with alignment grooves of a color different from the rest of the knob to assist the user, because, as shown above, the outer portion 102 may be molded with a slot 104 therein that allows viewing of a part of the inner portion 105 indicating a position of the knob (of a color different from that of the outer portion 102).

Figure 4:
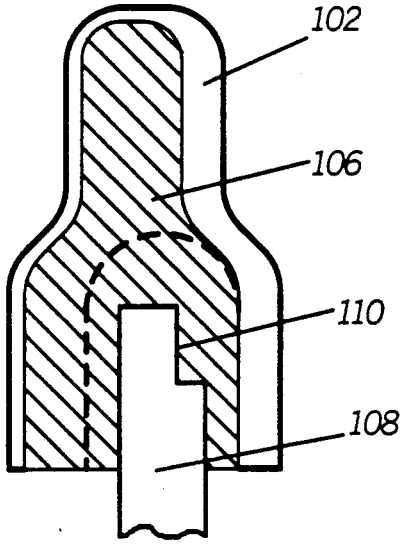
FIG. 4 shows a cross section of the knob, across the line A—A of FIG. 3.

Referring to FIG. 4, a cross section of the knob 100 across the line A—A of FIG. 3 is shown. The shaft 108 is shown as closely fitting within the inner portion 105. FIG. 4 also shows how the flat portion 110 prevents the inner portion 105 from rotating with respect to the shaft 108.

Figure 5:
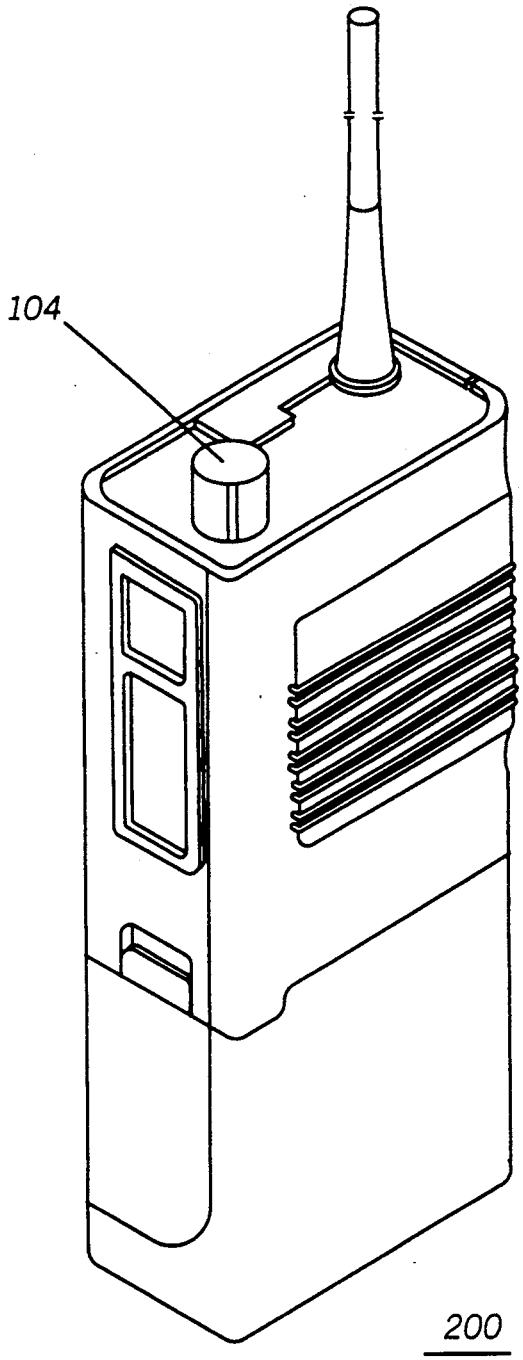
FIG. 5 shows the knob on a two-way portable radio.

Referring to FIG. 5, a radio 200 is shown with the knob 100. As is evident from this Figure, the knob 100 is exposed to possible shock by virtue of its position on the radio 200.

What is claimed is:

1. An instrument control knob comprising:

an inner portion comprising a plastic material having a substantially cylindrically main body; a blade portion longitudinally attached to said main body, an outer portion comprising a substantially cylindrical body having an outer surface and a cylindrical bore defined therein; said bore having a longitudinal slot communicating with said outer surface, said outer portion fitting over said inner portion so that at least a part of the inner portion is visible through the slot and the outer portion comprising a plastic material having a reduced hardness factor with respect to the inner portion; the color of the outer portion being different from that of the inner portion.

2. The knob of claim 1, wherein the outer portion is molded over the inner portion.

* * * * *